US012471741B2

(12) United States Patent
Corneil

(10) Patent No.: US 12,471,741 B2
(45) Date of Patent: Nov. 18, 2025

(54) DUAL DISPENSER FOR THE REDUCTION OF WASTED CONTENTS

(71) Applicant: Matthew Esteban Corneil, Incline Village, NV (US)

(72) Inventor: Matthew Esteban Corneil, Incline Village, NV (US)

( * ) Notice: Subject to any disclaimer, the term of this patent is extended or adjusted under 35 U.S.C. 154(b) by 165 days.

(21) Appl. No.: 18/525,720

(22) Filed: Nov. 30, 2023

(65) Prior Publication Data

US 2025/0176767 A1 Jun. 5, 2025

(51) Int. Cl.

| | |
|---|---|
| ***A47K 5/122*** | (2006.01) |
| ***A45D 34/04*** | (2006.01) |
| ***A47K 5/12*** | (2006.01) |
| ***B65D 1/02*** | (2006.01) |
| ***B65D 1/06*** | (2006.01) |
| ***B65D 41/04*** | (2006.01) |
| ***B65D 47/08*** | (2006.01) |
| ***B65D 83/00*** | (2006.01) |

(52) U.S. Cl.

CPC ..... *A47K 5/122* (2013.01); *A45D 34/04* (2013.01); *A47K 5/1205* (2013.01); *B65D 1/0246* (2013.01); *B65D 1/06* (2013.01); *B65D 41/04* (2013.01); *B65D 47/0838* (2013.01); *B65D 83/0094* (2013.01); *A45D 2200/05* (2013.01); *A45D 2200/055* (2013.01); *B65D 2501/0081* (2013.01)

(58) Field of Classification Search

CPC ..... A47K 5/122; A47K 5/1205; A45D 34/04; A45D 2200/05; A45D 2200/055; B65D 1/0246; B65D 1/06; B65D 41/04; B65D 47/0838; B65D 83/0094; B65D 2501/0081

USPC ..... 222/212, 630, 631

See application file for complete search history.

(56) References Cited

U.S. PATENT DOCUMENTS

| | | | | | |
|---|---|---|---|---|---|
| 1,348,062 | A * | 7/1920 | Shook | B65D 1/06 | 215/380 |
| 1,810,135 | A * | 6/1931 | Fitch | A45D 40/0075 | 222/321.5 |
| 5,366,119 | A * | 11/1994 | Kline | B05B 11/0037 | 222/321.5 |
| 11,617,477 | B1 * | 4/2023 | Fulbrook | A45D 34/00 | 222/401 |
| 2008/0302831 | A1 * | 12/2008 | Wang | B65D 1/06 | 222/321.5 |
| 2009/0242588 | A1 * | 10/2009 | Olson | G01F 11/028 | 222/331 |
| 2013/0284764 | A1 * | 10/2013 | Baxter-Waller | B65D 1/06 | 222/321.9 |

* cited by examiner

*Primary Examiner* — Samir Abdosh

(74) *Attorney, Agent, or Firm* — Goodman Law Center, P.C.

(57) ABSTRACT

A dual dispenser container is disclosed herein. The dual dispenser container includes a container, a pump dispenser at a top end of the container, and a second dispenser at a bottom end of the container. In some embodiments, the second dispenser is a flip-top dispenser. The dual dispensers on the container allow a user to utilize the pump dispenser until the contents in the container become too depleted to adequately use the pump dispenser, at which time the second dispenser can be used to dispense the remaining product from the bottom end of the container.

9 Claims, 6 Drawing Sheets

DUAL DISPENSER FOR THE REDUCTION OF WASTED CONTENTS

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of containers of existing art and more specifically relates to a container with dual dispensing mechanisms.

RELATED ART

Containers with pumps are commonly used for dispensing various liquids, creams, and lotions in a controlled and convenient manner. These containers typically consist of a bottle with a pump mechanism attached to the top, including a nozzle, a dip tube reaching into the product, and a piston or plunger for creating the pumping action.

There are several types of bottles that utilize pumps, each catering to specific products. For example, lotion pump bottles are frequently used for lotions, creams, moisturizers, and similar products; while liquid soap pump bottles are designed for hand soaps, body washes, and liquid cleansers. Shampoo and conditioner pump bottles are common for dispensing hair care products, and foam pump bottles create foam by mixing the product with air, often used for hand washes and facial cleansers.

However, pump mechanisms are not without their challenges. One significant issue is as the product within the bottle begins to deplete, pumps struggle to dispense the remaining product, resulting in incomplete usage and significant leftover product at the bottom of the bottle. Further issues include malfunctions of the pump, whether caused by faulty hardware or accumulated product residue, causing inconsistent or uneven dispensing, which can be frustrating for users.

Overall, pump dispensers often lead to wasted contents, which is not only frustrating for users but is also financially and economically problematic. Thus, a suitable solution is desired.

SUMMARY OF THE INVENTION

In view of the foregoing disadvantages inherent in the known pump container art, the present disclosure provides a novel dual dispenser for the reduction of wasted contents. The general purpose of the present disclosure, which will be described subsequently in greater detail, is to provide a container that has a pump dispenser at a top of the container and another dispenser at a bottom of the container that allows for the retrieval of all contents in the container, which is of particular benefit in circumstances where the pump dispenser is unable to reach the remaining contents in the container (e.g., when the container is close to empty). The dual dispenser for the reduction of wasted contents may be used across all bottle designs containing, but not limited to, cosmetic substances.

A dual dispenser container is disclosed herein. In some embodiments, the dual dispenser container includes a container, a pump dispenser and a second dispenser. The container may include an outer surface opposite an inner surface defining a container interior housing a flowable substance, and a top end opposite a bottom end. The top end may include a top end outlet providing access to the container interior through the top end of the container. Similarly, the bottom end may include a bottom end outlet providing access to the container interior through the bottom end of the container.

The pump dispenser may include a pump cap, a pump actuator and a pump conduit. The pump cap may be configured to attach to the top end outlet. The pump actuator may extend upwardly from the pump cap and the pump conduit may extend from the pump cap and into the container interior of the container when the pump cap is attached to the top end outlet.

The second dispenser may include a second dispenser cap configured to attach about the bottom end of the container and selectively close the bottom end outlet and a dispenser opening disposed in the second dispenser cap and in line with the bottom end outlet when the second dispenser cap is attached about the bottom end.

According to another embodiment, a dual dispenser container may include a flexible container, a pump dispenser and a flip-top dispenser. The flexible container may include an outer surface opposite an inner surface defining a container interior housing a flowable substance, and a top end opposite a bottom end. The top end may include a top end threaded neck surrounding a top end outlet providing access to the container interior through the top end of the container. The bottom end may include a bottom end outlet providing access to the container interior through the bottom end of the container.

The pump dispenser may include a threaded pump cap, a pump actuator and a pump conduit. The threaded pump cap may be configured to mate with the top end threaded neck. The pump actuator may extend upwardly from the threaded pump cap and the pump conduit may extend from the threaded pump cap and into the flexible container interior of the flexible container when the threaded pump cap is attached to the top end threaded neck.

The flip-top dispenser may include a flip-top dispenser cap configured to attach over the bottom end outlet; a dispenser opening disposed in the flip-top dispenser cap and in line with the bottom end outlet when the flip-top dispenser cap is attached to the bottom end outlet; and a lid hinged to a side of the flip-top dispenser cap to selectively close the dispenser opening. The lid may include a planar top surface to allow the flexible container to sit flat on a surface.

In some embodiments, a dual dispenser cosmetic container may also be disclosed herein. The dual dispenser cosmetic container may include a flexible container including an outer surface opposite an inner surface defining a flexible container interior housing a flowable cosmetic substance, and a top end opposite a bottom end. The top end may include a top end threaded neck surrounding a top end outlet providing access to the flexible container interior through the top end of the flexible container; and the bottom end may include a tapered base terminating at the bottom end, and a bottom end threaded neck surrounding a bottom end outlet that provides access to the flexible container interior through the bottom end of the flexible container.

A pump dispenser of the dual dispenser cosmetic container may include a threaded pump cap configured to mate with the top end threaded neck; a pump actuator extending upwardly from the threaded pump cap; and a pump conduit extending from the threaded pump cap and into the flexible container interior of the flexible container when the threaded pump cap is attached to the top end threaded neck.

A flip-top dispenser of the dual dispenser cosmetic container may include a flip-top dispenser cap, a dispenser opening and a lid. The flip-top dispenser cap may be configured to attach over the bottom end outlet. The flip-top dispenser cap may include a flip-top cap threaded neck disposed centrally within an interior of the flip-top cap and having internal threads for mating with the bottom end threaded neck. Further, the interior of the flip-top cap may include a depth configured to receive the tapered base of the bottom end.

The dispenser opening may be disposed in the flip-top cap and in line with the bottom end outlet when the flip-top cap threaded neck is attached to the bottom end threaded neck. The lid may be hinged to a side of the flip-top cap to selectively close the dispenser opening and may include a planar top surface, allowing the dual dispenser cosmetic container to sit flat on a surface, such as (but not limited to) a countertop.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a dual dispenser for the reduction of wasted contents, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a container and more particularly to a dual dispenser for the reduction of wasted contents. Major benefits derived from this invention include less wasted content, resulting in less purchases needed and less recycling of material needed. Additional benefits include consumers not having to find alternate options of getting all content out of the bottle, resulting in less mess and less irritation for the consumer.

Referring now more specifically to the drawings by numerals of reference, there is shown in FIGS. 1-6, various views of a dual dispenser container 100.

Figure 1:
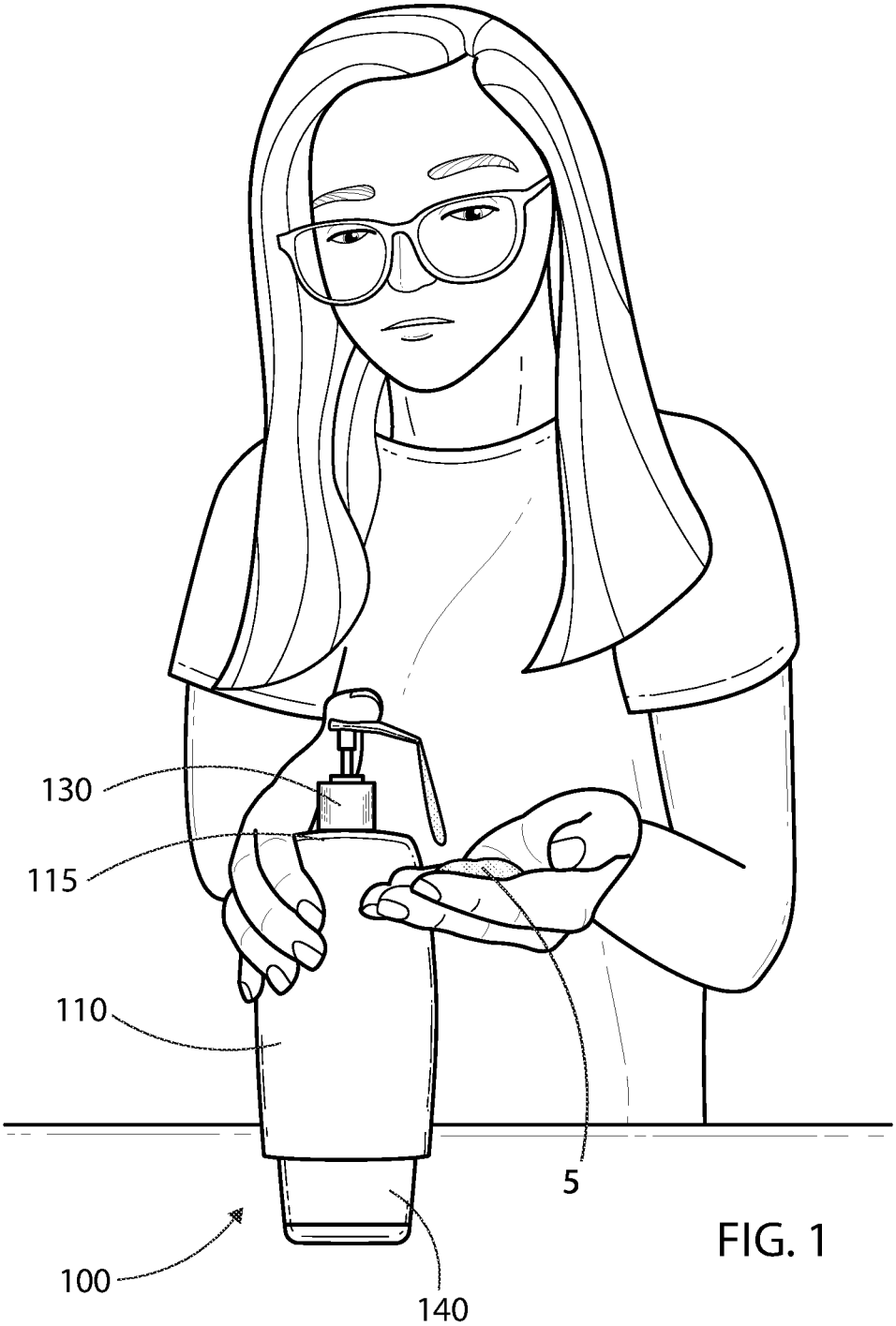
FIG. 1 is a front perspective view of a dual dispenser container including a container, a pump dispenser and a flip-top dispenser, the pump dispenser is shown being used to pump a flowable substance from a top end of the container, according to an embodiment of the disclosure.
Figure 2:
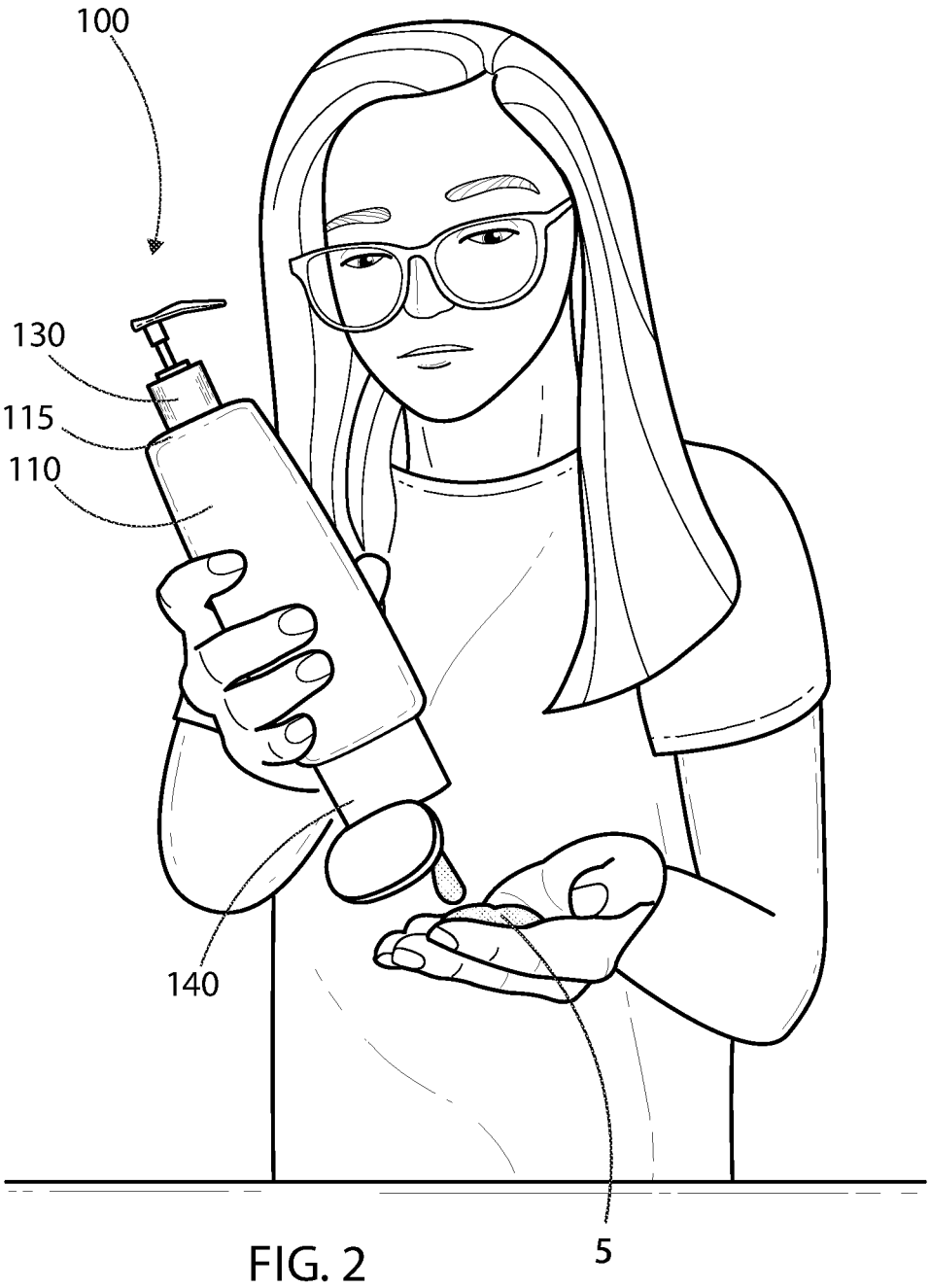
FIG. 2 is a front perspective view of the flip-top dispenser shown being used to dispense the flowable substance from a bottom end of the container, according to an embodiment of the disclosure.

Referring first to FIGS. 1-2, there is shown the dual dispenser container 100 in use by a user. As shown, the dual dispenser container 100 may include a container 110, a first dispenser 130 at a top end 115 thereof and a second dispenser 140 at a bottom end 116 (FIG. 3) thereof.

For example, FIG. 1 illustrates the first dispenser 130 being used. As shown here, the first dispenser may include a pump dispenser 130. The user is shown in FIG. 1 pumping a flowable substance 5 that is housed within the container 110. For example, in some embodiments, the flowable substance 5 may be a cosmetic substance such as (but not limited to) lotion, cream, oil, cleansing fluid, toning fluid, and the like. It should however be appreciated that this list is not exhaustive and the flowable substance 5 is not limited to being a cosmetic substance.

FIG. 2 illustrates use of the second dispenser 140. The second dispenser 140 may be located at the bottom end 116 (FIG. 3) of the container 110, opposite the pump dispenser 130, such that once the pump dispenser 130 is unable to adequately dispense the flowable substance 5 (for example, due to the pump dispenser 130 being unable to reach the flowable substance 5 located in the bottom end 116 of the container 110) the second dispenser 140 may then be utilized to dispense the remaining amount of the flowable substance 5 from the container 110. As shown here, in some embodiments, the second dispenser may be a flip-top dispenser 140.

Figure 3:
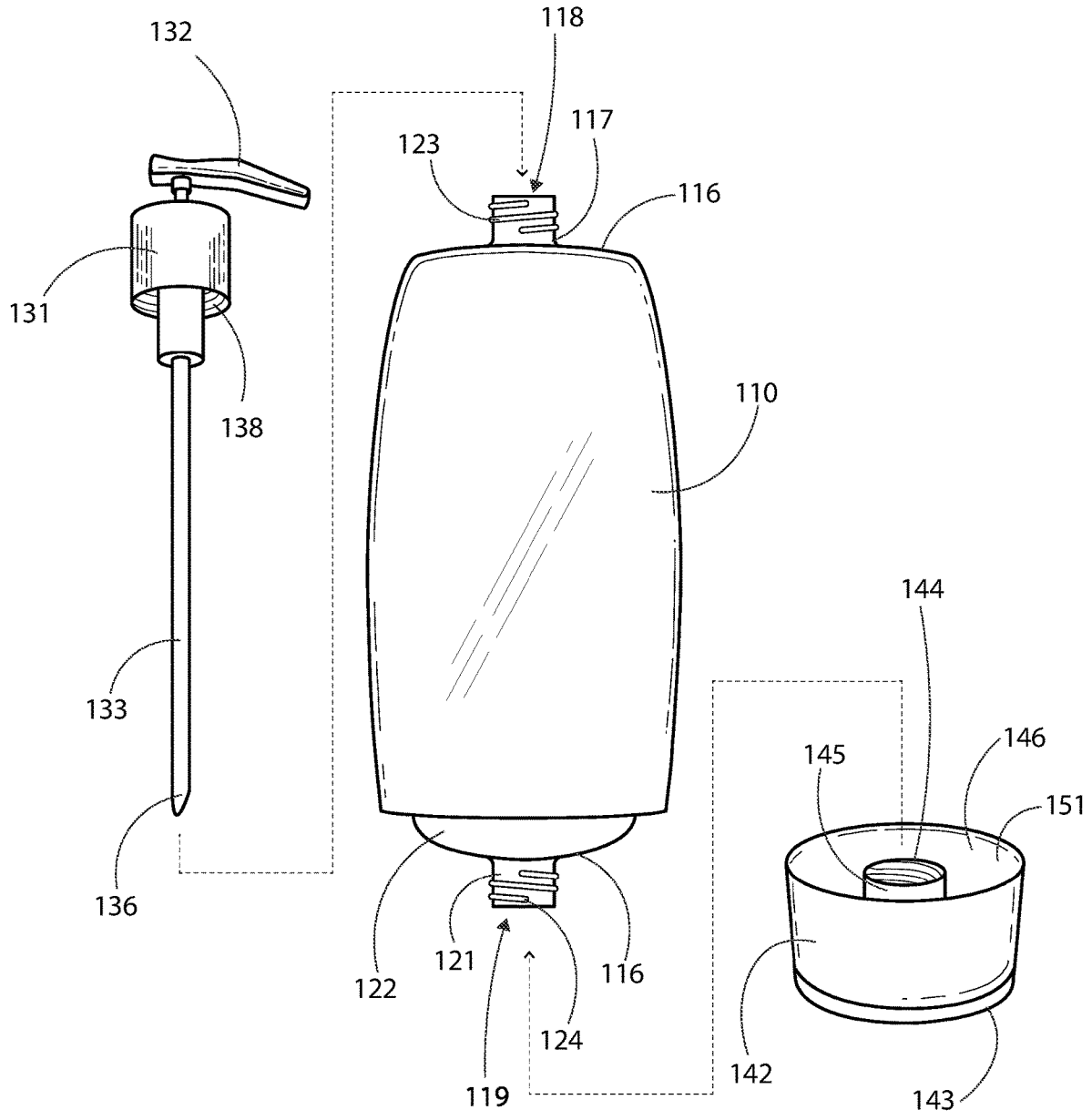
FIG. 3 is an exploded view of the dual dispenser container illustrating the container including a top threaded neck for attaching the pump dispenser to the container and a bottom threaded neck for attaching the flip-top dispenser to the container, according to an embodiment of the present disclosure.
Figure 4:
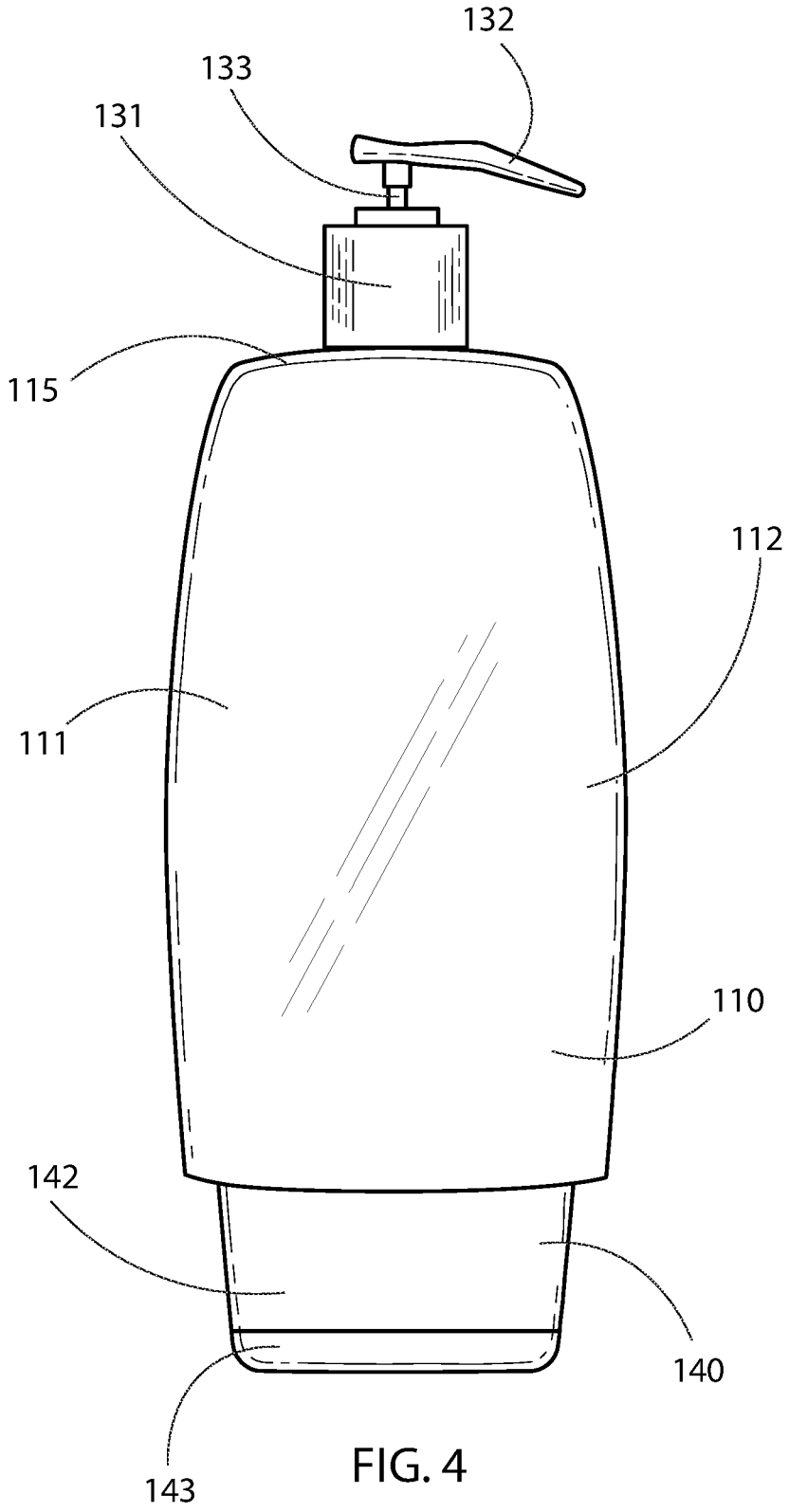
FIG. 4 is a front view of the dual dispenser container, according to an embodiment of the present disclosure.

Referring now more specifically to FIGS. 3-4, there is shown in FIG. 3 an exploded view of the container 110 without the pump dispenser 130 and the flip-top dispenser 140 attached, and in FIG. 4 a perspective view of the container 110 with the pump dispenser 130 and the flip-top dispenser 140 attached.

As shown here, the container 110 may include a body 111 having an outer surface 112 and the top end 115 opposite the bottom end 116. The body 111 may also include an inner surface (not illustrated in these figures) opposite the outer surface 112. The outer surface 112 and the inner surface may define a container interior (not illustrated in these figures) in which the flowable substance 5 may be housed. As above, the flowable substance 5 may be (but is not limited to) a cosmetic substance. In some embodiments, the container 110 may include an elongated shape such as (but not limited to) an oblong, cylindrical or tubular shape with a longitudinal axis of the container 110 extending between the top end 115 and the bottom end 116. It should however be appreciated that the container 110 is not limited to the configuration illustrated and described here.

As shown, the pump dispenser 130 may attach to the top end 115 of the container 110. In some embodiments, the attachment may be a threaded attachment. For example, as shown, the top end 115 may include a top end threaded neck 117 surrounding a top end outlet 118, which provides access to the container interior through the top end 115 of the container 110. Accordingly, the pump dispenser 130 may include a threaded pump cap 131 configured to mate with the top end threaded neck 117. Particularly, the threaded pump cap 131 may include internal threads 138 for mating with externally located threads 123 on the top end threaded neck 117.

As above, in some embodiments the second dispenser may include a flip-top dispenser 140 attached to the bottom end 116 of the container 110. Similar to the pump dispenser 130 above, the flip-top dispenser 140 may include a second dispenser cap, or a flip-top cap 142, including internal threads 144. Accordingly, the bottom end 116 of the container 110 may include a bottom end threaded neck 121 surrounding the bottom end outlet 119. As such, the internal threads 144 on the flip-top cap 142 may be configured to mate with external threads 124 on the bottom end threaded neck 121.

In some embodiments, the flip-top cap 142 may include an internal cap threaded neck 145 disposed centrally within an interior 151 of the flip-top cap 142. As such, in this embodiment, the flip-top cap threaded neck 145 may include the internal threads 144 therein configured to receive the bottom end threaded neck 121 therewithin (e.g., the bottom end threaded neck 121 is screwed into the flip-top cap threaded neck 145).

It should be noted that whilst threads are the attachment mechanisms discussed and shown throughout the figures, the present invention is not limited to threads as the means of attaching the dispensers 130, 140 to the container 110.

In some embodiments, the container 110 may include a generally tapered base 122 terminating at the bottom end 116. Accordingly, the flip-top cap 142 may include a depth 146 configured to receive the tapered base 122 of the bottom end 116. As shown here, in some embodiments, the flip-top cap 142 may include (but is not limited to) a generally elliptical cylindrical shape.

Still referring to FIGS. 3-4, as discussed above (and shown in FIG. 1), the pump dispenser 130 may be configured to pump an amount of the flowable substance 5 from the container interior. As such, as shown in these figures, the pump dispenser 130 may include the pump cap 131, which in some embodiments may be threaded as discussed above; a pump actuator 132 and a pump conduit 133. The pump dispenser 130 preferably operates in a normal manner well known in the art.

The pump actuator 132 may extend upwardly from the threaded pump cap 131 and outwardly. Particularly, the pump actuator 132 may extend outwardly at an angle (for example, between 80-100 degrees) to the pump conduit 133 and enables the user to actuate the pump action of the pump dispenser 130. Further, the pump actuator 132 may include a channel (not illustrated) therein in communication with the pump conduit 133 and configured to receive the flowable substance 5 therethrough when actuated by the user. The pump conduit 133 may extend from the threaded pump cap 131 and into the container interior of the container 110. A second end 136 of the pump conduit 133 may extend toward to a bottom of the container interior, allowing the pump conduit 133 to reach as much of the flowable substance 5 as possible.

Figure 5:
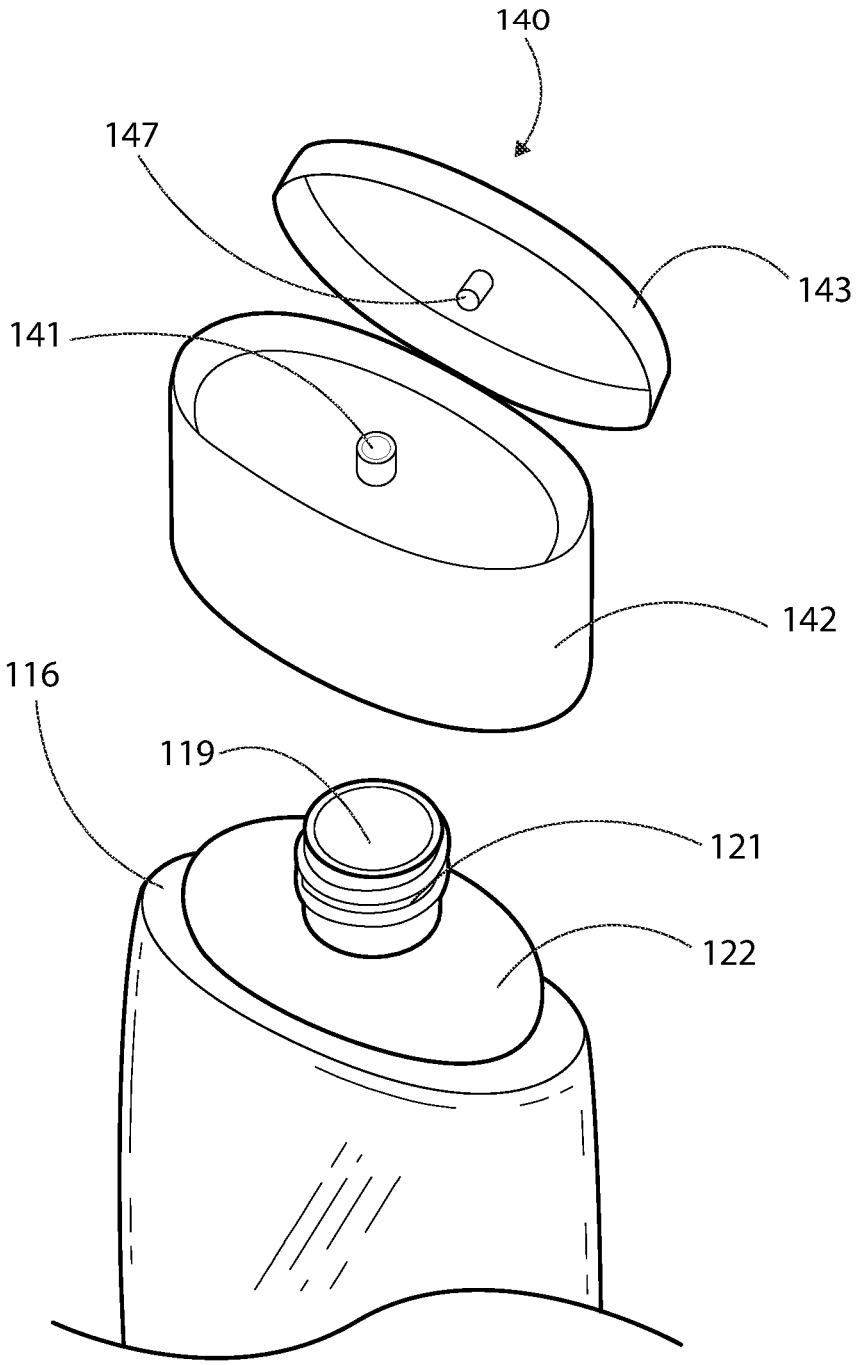
FIG. 5 is a partial exploded view of the flip-top dispenser and the bottom end of the container, the flip-top dispenser shown being open, according to an embodiment of the present disclosure.
Figure 6:
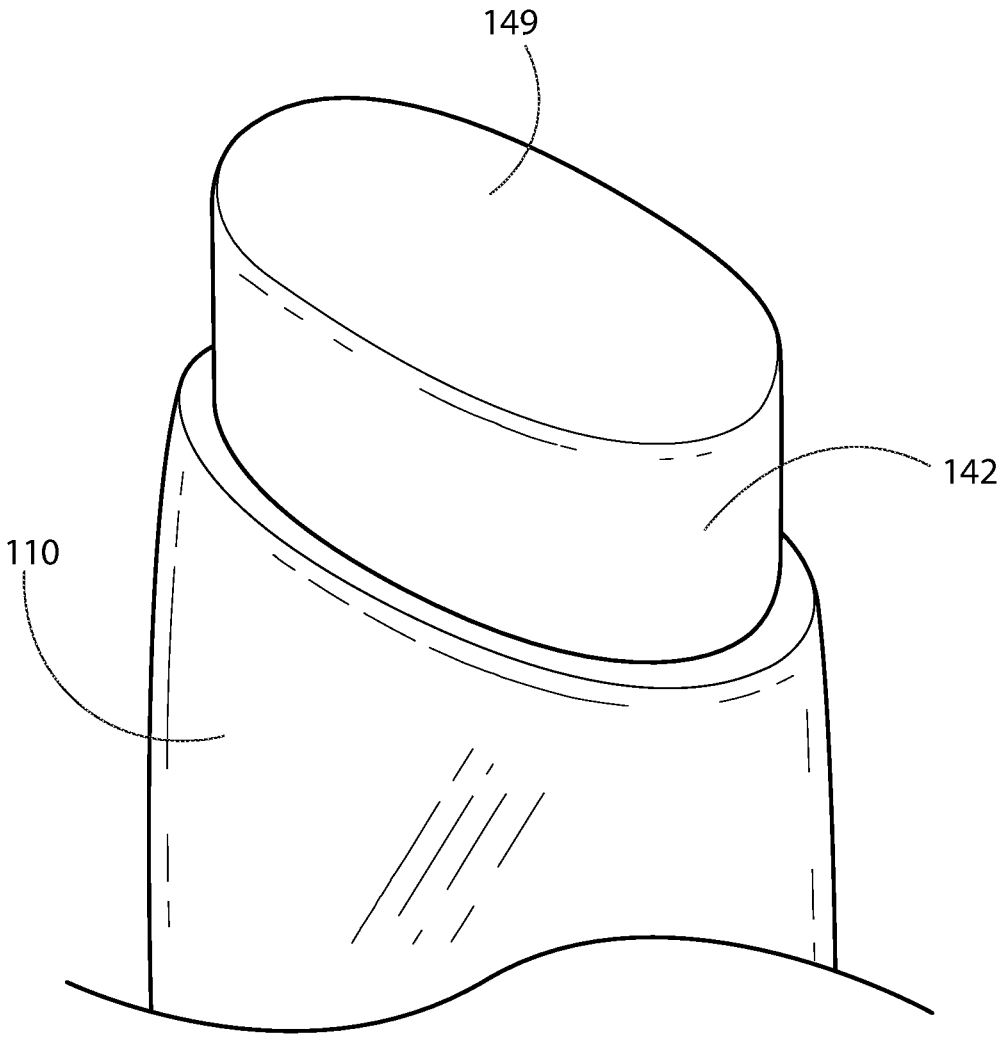
FIG. 6 is a perspective of the flip-top dispenser attached to the bottom end of the container, the flip-top dispenser shown being closed, according to an embodiment of the present disclosure.

Referring now also to FIGS. 5-6, there is shown in FIG. 5 a partially exploded detailed view of the flip-top dispenser 140, and in FIG. 6 a view of the flip-top cap 142 closed and attached to the top end 115 of the container 110.

The flip-top dispenser 140 may operate in a normal manner well known in the art. As shown in FIGS. 3-6, the flip-top dispenser 140 may include a dispenser opening 141 and a flip-top cap 142 configured to attach over the bottom end outlet 119 and selectively close the dispenser opening 141. The dispenser opening 141 is then in line with the bottom end outlet 119 such that the amount of the flowable substance 5 dispensed through the bottom end outlet 119 is directed through the dispenser opening 141.

As shown, the flip-top cap 142 may include a lid 143 attached to the flip-top cap 142 configured to selectively close the dispenser opening 141. The lid 143 may particularly be hinged to a side of the flip-top cap 142. Further, in some embodiments, a closure mechanism (not illustrated) may be provided for latching the lid 143 to the flip-top cap 142, allowing the flip-top cap 142 to close and prevent inadvertent dispensing of the flowable substance 5 through the flip-top dispenser 140.

The lid 143 may preferably include a planar top surface 149, as shown in FIG. 6, enabling the dual dispenser container 100 to be placed flat on a surface (such as a countertop), with the planar top surface 149 of the lid 143 contacting the surface. This may particularly enable easy pumping of the flowable substance 5 from the pump dispenser 130.

Further, in some embodiments, as shown particularly in FIG. 5, the lid 143 may include a seal or a plunger 147 attached to an interior center of the lid 143. The dispenser opening 141 may be located at a center of the flip-top cap 142 and aligned with the seal 147. As such, when the lid 143 is being closed, the seal or plunger 147 inserts into the dispenser opening 141 to seal the dispenser opening 141 and again prevent inadvertent dispensing of the flowable substance 5 through the flip-top dispenser 140.

To dispense the amount of flowable substance 5 from the flip-top dispenser 140, the user may open the lid 143 and apply pressure to (squeeze) the container 110, which pushes the flowable substance 5 out of the dispenser opening 141. As above, this may be particularly useful for when the pump conduit 133 is unable to reach the remaining amount of flowable substance 5 in the container 110. As such, the container 110 may include a generally flexible construction, enabling the user to squeeze the body 111 of the container 110.

In use, a user may first utilize the dual dispenser container 100 via the pump dispenser 130, pumping the flowable substance 5 from the top end 115 of the container 110 when desired. Once the flowable substance 5 is unable to be easily pumped by the pump dispenser 130, the user may then utilize the flip-top dispenser 140 at the bottom end 116 of the container 110. Particularly, the user may open the lid 143 of the flip-top dispenser 140 and squeeze the container 110, dispensing the flowable substance 5 from the bottom end 116 of the container 110 and through the dispenser opening 141.

It should be noted that, under appropriate circumstances, considering such issues as design preference, user preferences, marketing preferences, cost, structural requirements, available materials, technological advances, etc., other methods of use are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the relevant patent offices and the public generally, and especially the scientist, engineers and practitioners in the art who are not familiar with patent or legal terms or phraseology, to determine quickly from a cursory inspection the nature and essence of the technical disclosure of the application.

It should be noted that common but well understood elements that are useful or necessary in a commercially feasible embodiment are often not depicted in order to facilitate a less obstructed view of the various embodiments of the present invention.

What is claimed is:

1. A dual dispenser container comprising:

a container including an outer surface opposite an inner surface defining a container interior housing a flowable substance, and a top end opposite a bottom end, the top end including a top end outlet providing access to the container interior through the top end of the container, the bottom end including a bottom end outlet providing access to the container interior through the bottom end of the container;

a pump dispenser able to pump an amount of the flowable substance from the container interior, the pump dispenser including:

a pump cap configured to attach to the top end outlet;

a pump actuator extending upwardly from the pump cap; and a pump conduit extending from pump cap and into the container interior of the container when the pump cap is attached to the top end outlet; and a second dispenser able to dispense an amount of the flowable substance from the container interior, the second dispenser including:

a second dispenser cap configured to attach about the bottom end of the container and selectively close the bottom end outlet; and a dispenser opening disposed in the second dispenser cap and in line with the bottom end outlet when the second dispenser cap is attached to the bottom end;

wherein the second dispenser cap includes a lid to selectively close the dispenser opening; and wherein the lid is hinged to a side of the second dispenser cap.

2. The dual dispenser container of claim 1, wherein the lid includes a planar top surface.

3. A dual dispenser container comprising:

a flexible container including an outer surface opposite an inner surface defining a flexible container interior housing a flowable substance, and a top end opposite a bottom end, the top end including a top end threaded neck surrounding a top end outlet providing access to the flexible container interior through the top end of the flexible container, the bottom end including a bottom end outlet providing access to the flexible container interior through the bottom end of the flexible container;

a pump dispenser able to pump an amount of the flowable substance from the flexible container interior, the pump dispenser including:

a threaded pump cap configured to mate with the top end threaded neck;

a pump actuator extending upwardly from the threaded pump cap; and a pump conduit extending from the threaded pump cap and into the flexible container interior of the flexible container when the threaded pump cap is attached to the top end threaded neck; and a flip-top dispenser able to dispense an amount of the flowable substance from the flexible container interior, the flip-top dispenser including:

a flip-top cap configured to attach over the bottom end outlet;

a dispenser opening disposed in the flip-top cap and in line with the bottom end outlet when the flip-top cap is attached over the bottom end outlet; and a lid hinged to a side of the flip-top cap to selectively close the dispenser opening, the lid including a planar top surface.

4. The dual dispenser container of claim 3, wherein the bottom end further includes a bottom end threaded neck surrounding the bottom end outlet.

5. The dual dispenser container of claim 4, wherein the flip-top cap includes internal threads for mating with the bottom end threaded neck.

6. The dual dispenser container of claim 5, wherein the flip-top cap includes a flip-top cap threaded neck disposed centrally within an interior of the flip-top cap, the flip-top cap threaded neck having the internal threads therein.

7. The dual dispenser container of claim 6, wherein the flexible container includes a tapered base terminating at the bottom end.

8. The dual dispenser container of claim 7, wherein the interior of the flip-top cap includes a depth configured to receive the tapered base of the bottom end.

9. A dual dispenser cosmetic container comprising:

a flexible container including an outer surface opposite an inner surface defining a flexible container interior housing a flowable cosmetic substance, and a top end opposite a bottom end, the top end including a top end threaded neck surrounding a top end outlet providing access to the flexible container interior through the top end of the flexible container, the bottom end including a tapered base terminating at the bottom end and a bottom end threaded neck surrounding a bottom end outlet providing access to the flexible container interior through the bottom end of the flexible container;

a pump dispenser able to pump an amount of the flowable cosmetic substance from the flexible container interior, the pump dispenser including:

a threaded pump cap configured to mate with the top end threaded neck;

a pump actuator extending upwardly from the threaded pump cap; and a pump conduit extending from the threaded pump cap and into the flexible container interior of the flexible container when the threaded pump cap is attached to the top end threaded neck; and a flip-top dispenser able to dispense an amount of the flowable cosmetic substance from the flexible container interior, the flip-top dispenser including:

a flip-top cap configured to attach over the bottom end outlet and including a flip-top cap threaded neck disposed centrally within an interior of the flip-top cap, the flip-top cap threaded neck having internal threads for mating with the bottom end threaded neck, the interior of the flip-top cap including a depth configured to receive the tapered base of the bottom end;

a dispenser opening disposed in the flip-top cap and in line with the bottom end outlet when the flip-top cap threaded neck is attached to the bottom end threaded neck; and a lid hinged to a side of the flip-top cap to selectively close the dispenser opening, the lid including a planar top surface.

* * * * *